United States Patent [19]

Griffin et al.

[11] 4,332,056

[45] Jun. 1, 1982

[54] INFINITE POSITION DOOR HOLD-OPEN

[75] Inventors: Henry W. Griffin, Birmingham; Arthur W. Hollar, Jr., Grosse Pointe, both of Mich.

[73] Assignee: General Motors Corporation, Detroit, Mich.

[21] Appl. No.: 176,414

[22] Filed: Aug. 8, 1980

[51] Int. Cl.[3] ..... E05D 11/08; E05D 11/10

[52] U.S. Cl. ..... 16/341; 16/347

[58] Field of Search ..... 16/140, 141, 142, 144, 16/145, 146, 154, 341, 347

[56] References Cited

U.S. PATENT DOCUMENTS

| | | | |
|---|---|---|---|
| 1,055,346 | 3/1913 | McQuillan | 16/140 UX |
| 2,683,447 | 7/1954 | Pollock et al. | 16/146 X |
| 2,992,451 | 7/1961 | Schonitzer et al. | 16/141 |
| 3,010,143 | 11/1961 | Widmer | 16/140 |
| 3,091,819 | 6/1963 | Wheeler et al. | 16/140 X |
| 3,461,481 | 8/1969 | Bachmann | 16/140 |
| 3,517,965 | 6/1970 | Cowles et al. | 16/140 X |
| 3,584,333 | 6/1971 | Hakala | 16/140 |
| 3,643,289 | 2/1972 | Lohr | 16/142 |
| 3,965,531 | 6/1976 | Fox et al. | 16/140 |

FOREIGN PATENT DOCUMENTS

| | | | |
|---|---|---|---|
| 80456 | 1/1956 | Denmark | 16/140 |
| 1909335 | 9/1970 | Fed. Rep. of Germany | 16/144 |
| 637992 | 5/1950 | United Kingdom | 16/141 |
| 885630 | 12/1961 | United Kingdom | 16/140 |

*Primary Examiner*—Wm. Carter Reynolds

*Attorney, Agent, or Firm*—Patrick M. Griffin

[57] ABSTRACT

The free end of an arm rotatable with one hinge member contains a roller receiving cavity which opens to an arcuate friction layer on the other hinge member which is disposed about the axis of relative rotation of the hinge members. A spring biased double faced wedging member is movable into and out of the center of the cavity and each face of the member is respective to a semi-cylindrical roller retention surface of the cavity. One face is more steeply sloped than the other. When the hinge members are in door closed position the less steeply sloped face resiliently holds a cylindrical roller against a roller retention surface and the friction layer. As the hinge members rotate toward door open position, the cylindrical roller rotates along the friction layer, past the less steeply sloped face, and into rolling contact with the other retention surface and friction layer under the bias of the more steeply sloped face. When the hinge members move to the desired door open position, a slight reversal thereof causes the more steeply sloped face to force the roller into the friction layer and roller retention surface to provide a hold-open.

3 Claims, 4 Drawing Figures

INFINITE POSITION DOOR HOLD-OPEN

BACKGROUND OF THE INVENTION

This invention relates generally to infinite position door hold-opens and more particularly to such a hold-open which includes a spring biased wedging member and a movable roller cooperatively providing a hold-open responsive to reversal of door opening movement.

DESCRIPTION OF THE PRIOR ART

Infinite position hold-opens are known in the prior art. Schonitzer U.S. Pat. Nos. 2,992,451 and Bachman 3,461,481 show biased friction members in constant frictional engagement with an arcuate member. Lohr U.S. Pat. No. 3,643,289 shows two relatively movable frictional members with means for adjusting the force therebetween dependent upon door position. Hakala U.S. Pat. Nos. 3,584,333 and Fox 3,965,531 both show brake members which are frictionally engaged by an actuating means responsive to reversal of door opening movement. Widmer U.S. Pat. No. 3,010,143 shows a roller wedged into a spring leaf member by the action of a stepped arcuate member.

SUMMARY OF THE INVENTION

The hold-open device of the invention, while disclosed in combination with a vehicle door mounted by relatively rotatable hinge members, may be applied wherever hold-open action between relatively rotatable parts is desired. As disclosed, one hinge member includes a friction layer disposed about the axis of relative rotation of the hinge members while the other hinge member has an arm which rotates with it relative to the friction layer. The free end of the arm contains a cavity open to the friction layer and movable concentrically with respect to the friction layer. The cavity contains a pair of spaced apart end walls having semi-cylindrical roller engaging or retention surfaces. A double faced wedging member is located between the end walls and is movable transversely to the cavity. Each face of the wedging member is respective to one of the surfaces, with one face of the wedging member being sloped more steeply relative to the friction layer than the other. A biasing means biases the wedging member toward the friction layer, and a cylindrical roller is contained in the cavity in alternate engagement or contact with a respective surface, a wedging member face, and the friction layer. The wedging member continuously biases the roller into the friction layer and the respective surface.

When the door is closed, the roller is held against the friction layer and respective surface by the less steeply sloped wedging member face. As the door is initially opened, the roller rolls along the friction layer and along the less steeply sloped wedging member face and moves the wedging member out of the cavity against the force of the biasing means thus permitting the roller to move past the line of intersection of the two wedging member faces and into engagement with the other surface and the more steeply sloped wedging member face. Thereafter, the roller rolls along the friction layer and slidingly rotates with respect to the other surface and more steeply sloped wedging member face until the desired open position of the door is attained. When the door movement is thereafter slightly reversed manually or by the tendency of the door to fall shut under its own weight and the inclination of the hinge member axes, the roller is forced against the more steeply sloped wedging member face. The weight of the door is insufficient to move the roller past this more steeply sloped wedging member face against the force of the biasing means. Consequently, the more steeply sloped wedging member face maintains the roller in contact with both the friction layer and its respective surface to hold the door open. To close the door, the operator applies sufficient manual force to move the roller past the more steeply sloped wedging member face and past the line of intersection of the wedging member face where it again will contact or engage the less steeply sloped wedging member face and its respective surface, and the roller will roll relative to both as the door closes.

Consequently, one of the features of this invention is to provide a hold-open action at any relative position of hinge members through the action of a roller wedged into a friction layer on one hinge member by a wedging member on the other hinge member. Another feature is that the roller rolls in a cavity in the other hinge member between opposite end walls of the cavity, with the hold-open being provided by a resiliently biased wedging member which moves into and out of the cavity under a spring force to wedge the roller into the friction layer and one of the cavity end walls. A further feature is that the wedging member contains two intersecting faces, each respective to a cavity end wall, one of which is less steeply sloped relative to the friction layer to allow the roller to move easily past it into contact with the alternate wedging member face and cavity end wall as the door is opened, while the other wedging member face is more steeply sloped so that the roller will not move past it unless sufficient force is applied by the operator.

These and other features of the invention will be readily apparent from the following specification and drawings.

DESCRIPTION OF THE PREFERRED EMBODIMENT

Figure 1:
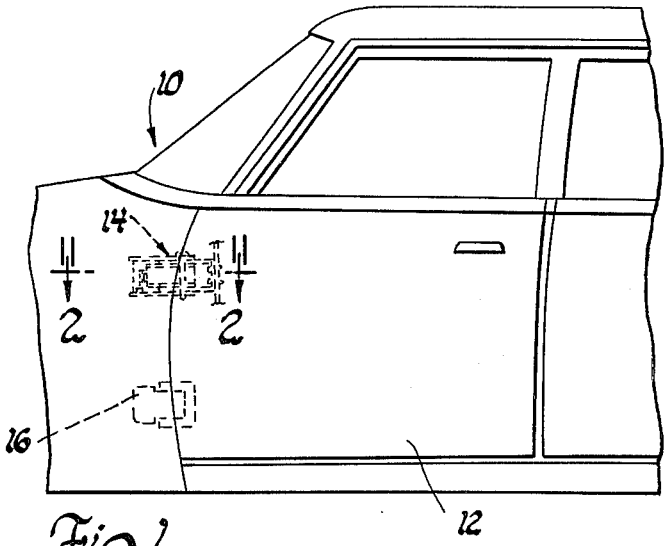
FIG. 1 is a partial view of a vehicle with a door supported thereon by an upper hinge including the subject hold-open device, and a lower hinge of conventional construction, and with the door shown in closed position.

Referring to FIG. 1, a vehicle 10 is shown with door 12 supported thereon by upper and lower hinge members 14 and 16. Upper hinge member 14 includes the subject hold-open device, while the lower hinge member 16 is conventional and not further described.

Figure 2:
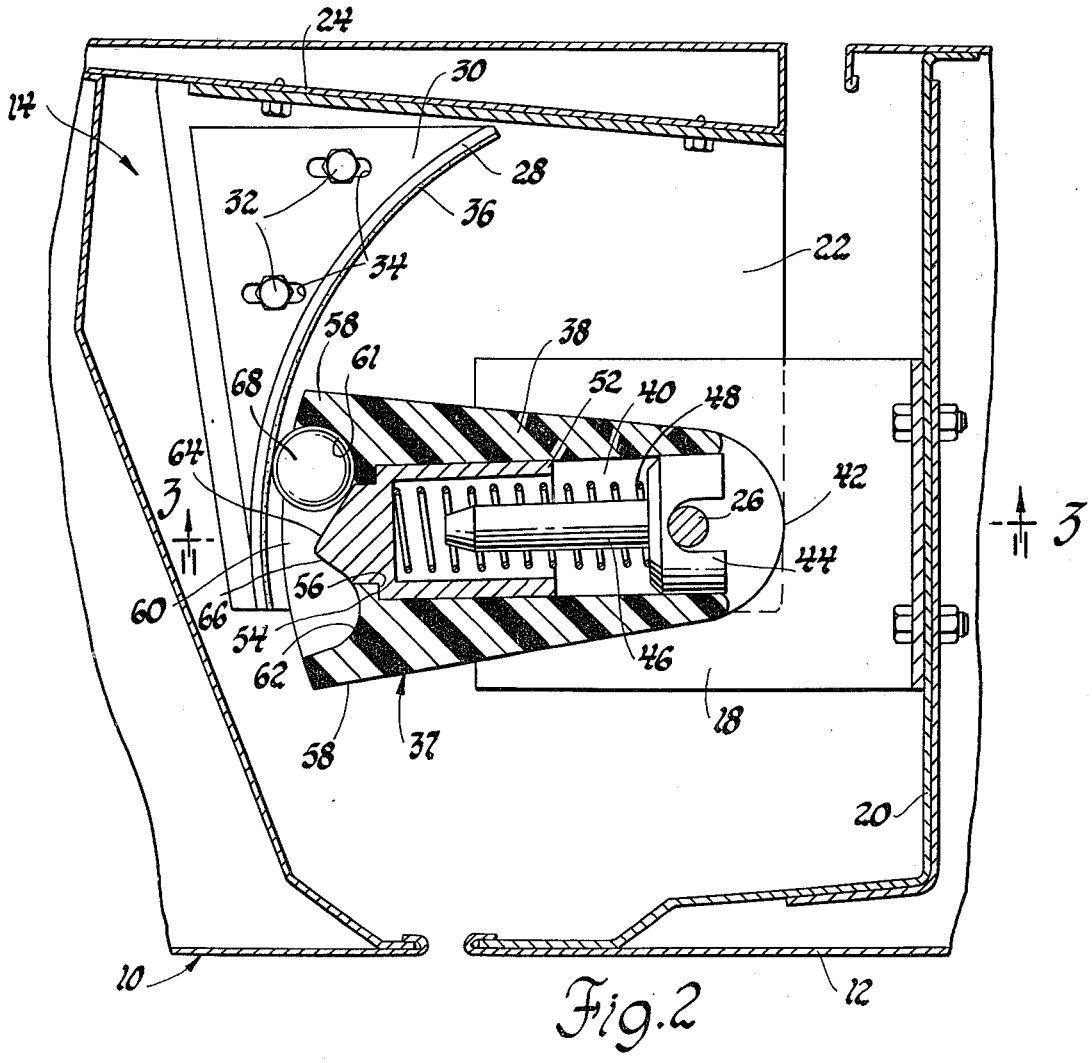
FIG. 2 is a sectional view taken along the line 2—2 of FIG. 1.
Figure 3:
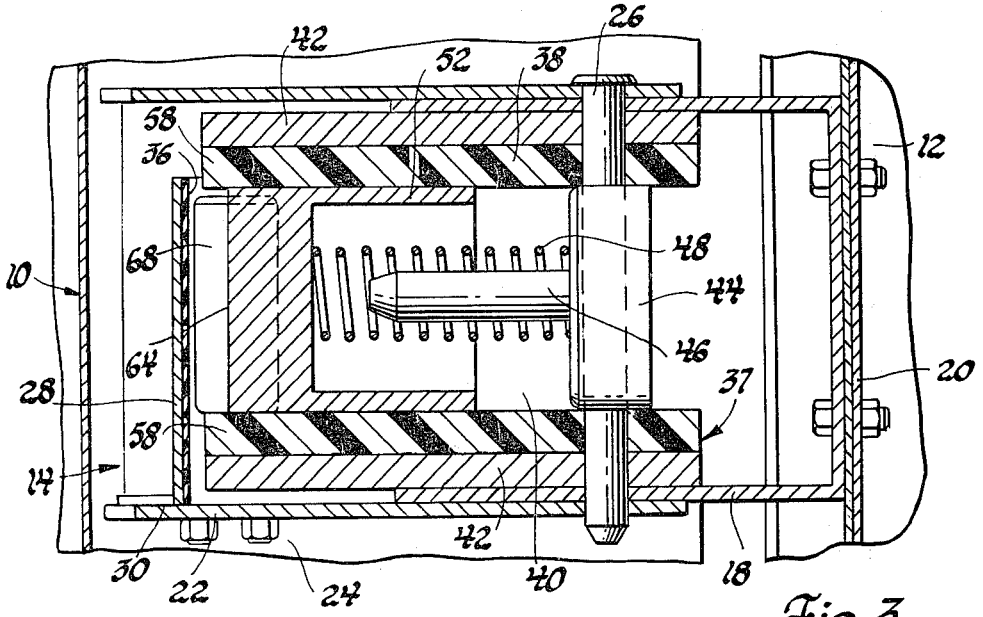
FIG. 3 is a sectional view taken along the line 3—3 of FIG. 2.

Referring now to FIGS. 2 and 3, hinge member 14 includes channel-shaped hinge bracket 18 bolted to hinge pillar face 20 of door 12 and channel-shaped hinge bracket 22 bolted to the face of body hinge pillar 24. Door mounted bracket 18 fits closely within body mounted bracket 22 and the two are pivoted together by shouldered hinge pin 26 and treated with anti-squeak materials in conventional fashion.

Hinge bracket 22 includes an arcuate member 28 disposed about an arc of rotation with hinge pin 26 at the center. Arcuate member 28 has a base 30 attached to bracket 22 by bolts 32 which extend through elongated holes 34 in base 30 into the lower leg of hinge bracket 22. The elongation of holes 34 allows for post assembly adjustment of arcuate member 28 relative to other elements, the purpose for which will be discussed below. The concave surface of arcuate member 28 is coated with a suitable friction material such as a thin coating of hard rubber 36.

A rotatable arm designated generally at 37 is movable with hinge member 18 and includes a plastic housing designated generally 38 which has a rectangular cross-sectioned bore 40 contained therein. Upper and lower metal plates 42 are bonded to plastic housing 38 and also to the inner surfaces of the upper and lower legs of hinge bracket 18 so that arm 37 moves with hinge bracket 18 and therefore matches the door rotation. Hinge pin 26 also extends through holes in upper and lower plates 42 and through housing 38 thus serving to locate all parts for relative rotation. Pin 26 also serves as the seat for spring seat 44 which further includes a guide pin 46 which holds and guides spring 48. A double faced wedging member 52 of an outside shape matching the shape of bore 40 is contained with bore 40 and biased toward arcuate member 28 under the force of spring 48. Vertical shoulders 54 on wedging member 52 seat against matching shoulders 56 contained in housing 38 to limit the extension of wedging member 52. Thus, wedging member 52 may slide back in bore 40 against the action of spring 48 but will not extend further than the position shown in FIG. 2.

Housing 38 further includes a pair of oppositely spaced roller retention legs 58 which extend between the housing upper and lower walls 42 thereby forming a cavity 60 opening to friction layer 36. This cavity moves concentrically to the friction layer as arm 37 moves. Retention legs 58 contain semi-cylindrical roller engaging or retention surfaces 61 and 62 which form the end walls of the cavity and which are respective to sloped faces 64 and 66 of wedging member 52. Face 66 of wedging member 52 is sloped more steeply relative to friction layer 36 than is face 64, for reasons to be described.

Completing the construction, a cylindrical roller 68 of a radius generally matching that of semi-cylindrical surfaces 61 and 62 is alternately located within one of the surfaces and in tangential engagement with a respective face of wedging member 52. Arcuate member 28 is adjusted through the elongated holes 34 so that roller 68 slightly compresses spring 48 at all positions of roller 68 relative to friction layer 36.

Figure 4:
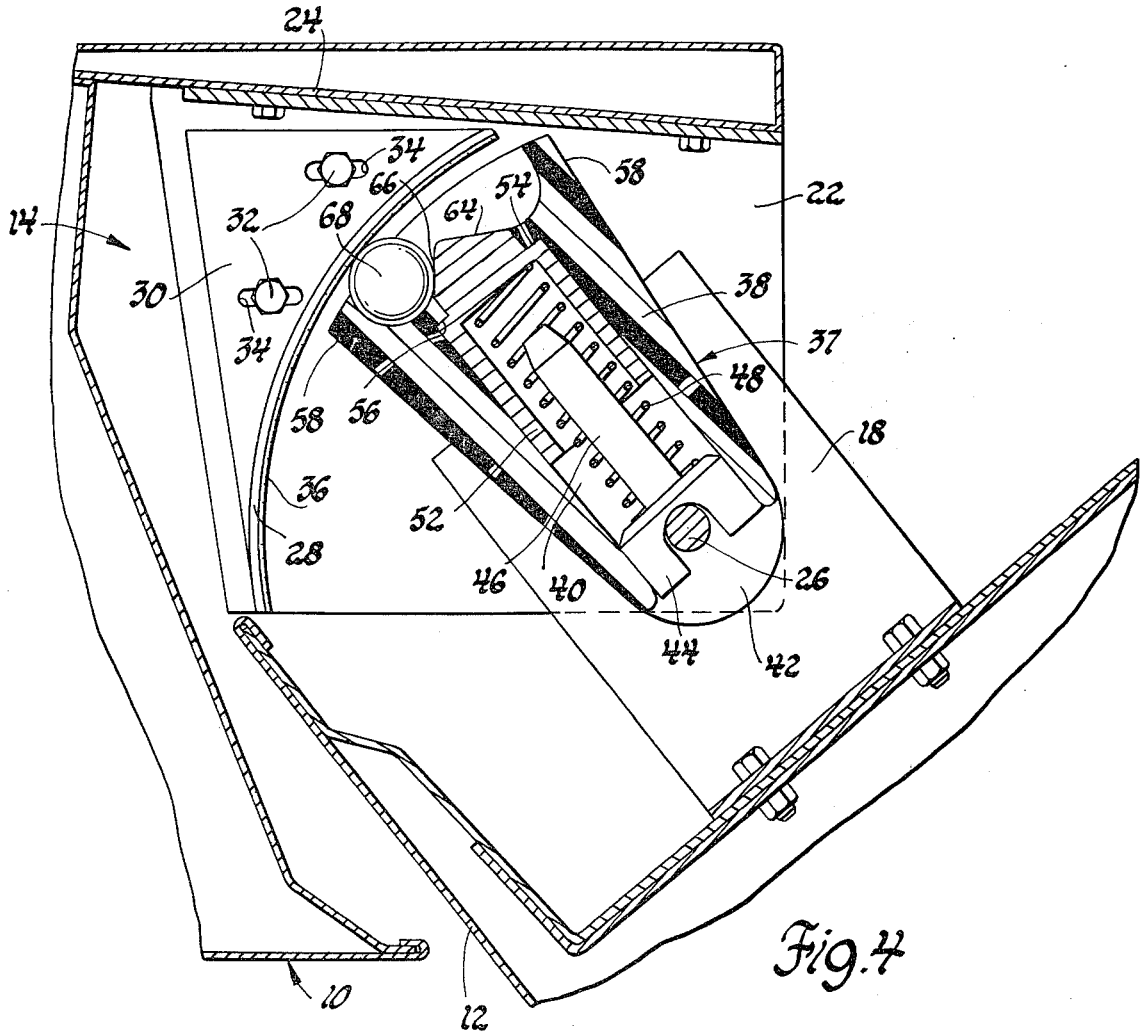
FIG. 4 is a view similar to FIG. 2 showing the door in the open position.

The operation of the device may be understood by referring to FIG. 2 showing the door in a closed position and FIG. 4 showing the door in open position. With the door closed in FIG. 2, roller 68 is in frictional engagement with friction layer 36, semi-cylindrical surface 61 and wedging member face 64. As the operator moves the door clockwise toward the FIG. 4 open position, wedging member face 64 is forced into roller 68. Because the coefficient of sliding friction is greater than the coefficient of rolling friction, wedging member face 64 rolls the roller along friction layer 36. As roller 68 moves, wedging member face 64 moves more rapidly with respect to friction layer 36 than does the roller, thereby moving the roller past wedging member face 64, against the action of spring 48. When roller 68 passes the line where wedging member face 64 and 66 intersect, the slope of face 66 and the force of spring 48 act to move or cam the roller into contact with surface 62. The manual operator force necessary to move the roller as just described is determined by the slope of face 64 and strength of spring 48, and is set at a minimum level.

During continued door opening movement, roller 68 continues to roll counterclockwise along friction layer 36, and rotates slidingly with respect to surface 62 and face 66. While this creates more resistance to movement than existed during initial opening movement, surface 62 is shaped so as not to bind roller 68 and the necessary operator force is not prohibitive. At the fully opened position, as seen in FIG. 4, the operator opening force will be removed and the door will tend to fall shut under its own weight due to the inclination of the hinge member axes. Therefore, roller 68 will now tend to wedge between friction layer 36 and wedging member face 66. Now, however, because of the steeper slope of face 66 and its consequently shorter effective ramp length, the weight of the door is not sufficient to compress spring 48 over the shorter effective ramp length to roll roller 68 up face 66, so the spring keeps roller 68 wedged against surface 62 and friction layer 36. The weight of the door is also not sufficient to cause roller 68 to slide along friction layer 36. Therefore, roller 68 is prevented from either sliding or rolling with respect to any of the surfaces surrounding it, and a hold-open action is provided. To close the door, sufficient operator force is applied to the door to compress spring 48 causing the roller to roll clockwise up face 66 and along friction layer 36 to the line of intersection of face 66 and face 64, where it will again be forced by spring 48 into contact with surface 61 and face 64 where it will roll clockwise until the door is back in the closed position of FIG. 2.

The strength of spring 48 and slopes of wedging member faces 66 and 64 as well as the coefficient of friction of layer 36 are chosen and combined to create the necessary hold-open forces for various sizes and weights of doors. Thus, an improved infinite position hold-open is provided.

The embodiments of the invention in which an exclusive property or privilege is claimed are defined as follows:

1. In combination with a vehicle having a door, an infinite position door hold-open comprising, a pair of hinge members rotatable relative to another for mounting the door on the vehicle body for movement between open and closed positions, one hinge member including an arcuate friction layer radially disposed about the axis of the hinge members, the other hinge member including therein a cavity which opens to the friction layer and includes a spaced pair of roller retention surfaces, a roller which rolls in the cavity along the friction layer from engagement with one retention surface to the other during door opening and closing movement, and resilient biasing means included on the other hinge member and including a wedging member face resiliently wedging the roller against the friction layer and one of the retention surfaces as the door is initially moved in a closing direction from the fully open position to provide a hold-open.

2. An infinite position door hold-open comprising, a pair of hinge members rotatable relative to one another between open and closed positions, one hinge member including an arcuate friction layer disposed radially about the axis of relative rotation of the hinge members, the other hinge member including a cavity opening to the friction layer and bounded at its opposite ends by a pair of roller engaging surfaces, a roller contained in the cavity in frictional engagement with the friction layer for rolling movement along the friction layer by alternate ones of the roller engaging surfaces during relative rotation of the hinge members, a wedging member mounted on the other hinge member and including a pair of intersecting faces sloped in opposite directions with respect to the friction layer, each face being respective to one of the roller engaging surfaces and being in tangential engagement with the roller when it is in contact with the respective roller engaging surface, means associated with the other hinge member to resiliently bias the wedging member faces into the roller and the roller into the respective roller engaging surface and the friction layer, the roller moving along the engaged face to compress the wedging member and move past the intersection of the faces into engagement with the other face and its respective roller engaging surface upon the initial rotation of the hinge members in an opening direction, the other face wedging the roller against the friction surface and its respective roller engaging surface upon a reversal of the direction of relative rotation of the hinge members to provide a hold-open.

3. An infinite position door hold-open for a vehicle having a pair of relatively rotatable hinge members mounting a door on the vehicle for rotation between closed and open positions, comprising, an arcuate member associated with one hinge member and disposed about an arc of relative rotation of the hinge members with a friction layer on the surface of the arcuate member, an arm associated with the other hinge member and rotatable therewith, a free end of which rotates concentrically with the arcuate member and further includes a roller receiving cavity open to the friction layer, a wedging member associated with the arm and movable transversely into and out of the roller receiving cavity and including an intersecting pair of faces sloped in opposite directions with respect to the friction layer, one face being more steeply sloped than the other, the free end of the arm also comprising a pair of roller retention surfaces, a first surface being respective to the less steeply sloped wedging member face and a second surface respective to the more steeply sloped wedging member face, a cylindrical roller biased by the less steeply sloped wedging member face into the first roller retention surface and the friction layer when the door is in the closed position, the roller rolling along the friction layer and moving out of engagement with the first roller retention surface and past the less steeply sloped wedging member face into engagement with the more steeply sloped wedging member and second roller retention surface as the door is opened, the roller continuing to roll along the friction layer and slidably rolling with respect to the more steeply sloped wedging member face and the second roller retention surface until the fully open position of the door is reached, the roller then being biased into the second roller retention surface and the friction layer by the more steeply sloped wedging member face as the direction of door movement is incrementally changed toward the closed position, the slope of the more steeply sloped wedging member face, coefficient of friction of the friction layer and the strength of the biasing means being chosen so that the roller will not move past the more steeply sloped wedging member face without the application of sufficient force by the door operator, thus providing a hold-open.

* * * * *